US007520093B2

(12) United States Patent
Guhl

(10) Patent No.: US 7,520,093 B2
(45) Date of Patent: Apr. 21, 2009

(54) FRAME CONSTRUCTION OF A SLIDING DOOR

(76) Inventor: Beat Guhl, Unterholzstrasse 21, 8561 Ottoberg (CH)

( * ) Notice: Subject to any disclaimer, the term of this patent is extended or adjusted under 35 U.S.C. 154(b) by 635 days.

(21) Appl. No.: 10/960,749

(22) Filed: Oct. 8, 2004

(65) Prior Publication Data

US 2005/0166494 A1 Aug. 4, 2005

(30) Foreign Application Priority Data

Jan. 13, 2004 (CH) ..... 0047/04

(51) Int. Cl.
*E06B 1/04* (2006.01)

(52) U.S. Cl. ..... 52/204.1; 52/204.52; 52/209; 52/243.1

(58) Field of Classification Search ..... 52/209, 52/204.52, 171.1, 243.1, 207, 204.1
See application file for complete search history.

(56) References Cited

U.S. PATENT DOCUMENTS 5,116,142 A * 5/1992 Smith et al. ..... 384/55
5,910,083 A * 6/1999 Richardson et al. ..... 52/171.1

FOREIGN PATENT DOCUMENTS

BE 1 002 537 3/1991
BE 1 002 537 A 3/1991
EP 0 080 870 6/1983
EP 1 101 894 B1 5/2001
EP 1 353 034 A2 10/2003
FR 2 363 686 3/1978
FR 2 363 686 A 3/1978
GB 2 150 188 A 6/1985

* cited by examiner

*Primary Examiner*—Basil Katcheves
(74) *Attorney, Agent, or Firm*—Browdy and Neimark, P.L.L.C.

(57) ABSTRACT

A frame construction of a sliding door or a sliding window has a main frame, a displaceable running carriage (4) for holding a displaceable door wing (T) or window sash, holding profiles (5) for holding the door wings (F, T) or window sashes, outer sealing elements (8) which bear in a sliding manner between the holding profiles (5) and an outer region of the main frame, and inner sealing elements (8') which bear in a sliding manner between the holding profiles (5) and an inner region of the main frame. There is furthermore an insulating body (7) which divides the main frame into an outer and an inner frame part (1, 2) and completely separates these parts from each other. The inner sealing element (8') bears against the insulating body (7) or against a central frame part (3) of the main frame, the central frame part (3) being completely separated from the first and second frame parts (1, 2). The frame construction has improved heat insulation, is nevertheless of relatively narrow design and can be produced cost-effectively through the use of individual parts which are as symmetrical as possible.

8 Claims, 9 Drawing Sheets

300
100
900
700
270
230
h
a
b
170
190
110
130
290
500
330
310
600
210
150

FRAME CONSTRUCTION OF A SLIDING DOOR

TECHNICAL FIELD

The invention relates to a frame construction of a sliding door or a sliding window. The invention furthermore relates to a frame for a sliding door or a sliding window.

PRIOR ART

A frame construction is disclosed in EP-A-0 080 870. Two plastic holding profiles for holding one door wing each are arranged in an aluminium main frame The holding profile of the displaceable door wing is provided with a running carriage which can be displaced guided in the main frame. The two holding profiles are separated by means of a separating element which protrudes between the holding profiles and which is integrally formed on the main frame. This separating element serves in addition to hold sealing brushes which bear in a sliding manner against the displaceable holding profile.

Sliding windows having a similar construction are disclosed in GB-A-2 150 188. In this case too, there is a main frame in which the holding profiles for the window panes are retained or guided displaceably Both constructions have the disadvantage that the main frame is of continuous design from the outside to the inside It therefore forms a cold bridge between the outside and the inside of the window or the door.

Furthermore, a construction which has a two-part main frame in order to avoid such cold bridges is commercially known. In this case, the inner and the outer parts of the frame are separated from each other by means of an insulating body. The holding profile of the displaceable door wing is arranged within the outer frame part. Sealing brushes which bear in a sliding manner against the displaceable holding profile are arranged on both sides of this outer frame part. The two frame parts are of u-shaped design. Since, however, one limb of the respective outer part protrudes from the cold region into the warm region, condensation of water occurs at this point. Also, the holding profiles of the insulating pane of glass are not insulated and therefore form a continuous cold bridge.

Furthermore, EP-A-1 101 194 discloses a frame construction for sliding doors, in which each door wing is retained in an L-shaped inner frame. In this case, the limbs of the L-shaped frame extend in the lower, horizontal direction and in a later al, vertical direction. The two free sides of the door wing run in an outer frame which has, in the region of these two sides, an inner and an outer frame part separated by means of an insulating body. The window panes are retained along these two sides in holding profiles which are laterally provided with brushes. These inner brushes slide along the insulating body when the door is displaced. This construction has the disadvantage that the free window surface is bounded by the L-shaped inner frame. In addition, the construction is suitable only for double-wing doors and cannot be used for multi-wing doors. In addition, because of the lower insulating body the construction has a relatively high sill in the lower region. Since this frame construction has differently constructed sides, it is relatively expensive to produce and complicated to install.

SUMMARY OF THE INVENTION

It is therefore an object of the invention to provide a frame construction of a sliding door or a sliding window which eliminates the abovementioned disadvantages.

In the case of the frame construction according to the invention, the frame is of three-part design, the first, outer frame part and the second, inner frame part being completely separated from each other at least along the guideway of the running carriage by means of an insulating body. In this case, inner sealing elements bear in a sliding manner between a holding profile for a door wing or window sash and the insulating body or a central frame part. In the first case, the insulating body forms the third part, in the second case the central frame part.

In preferred embodiments, the inner sealing elements are retained on the central frame part, on the insulating body or between these two.

If there is a central frame part, it is preferably completely separated from the first and from the second frame parts. In addition, the central frame part is interrupted by a further sealing part, preferably a brush.

The arrangement of the inner sealing elements or the further sealing part prevents cold bridges from arising between the inner and outer frame parts. The condensation of water is also avoided.

The frame construction can be formed without a sill in the lower region. The free window area is maximized. Since the identical parts for the inner, outer and central frame parts and for the insulating body can be used on all four sides of the frame construction, the production and installation costs are minimized.

It is a further object of the present invention to provide a frame for a sliding door or a sliding window, the profile of which permits rear ventilation of the distance-retaining elements and at the same time ensures optimum thermal insulation between that limb of the frame which comes to lie on the outside of the structure and that limb of the frame which comes to lie on the inside of the structure.

The design of the cross section of the profile for the frame makes it possible to connect it in a leakproof manner cost-effectively and easily to the glass panels, which are already connected and customized by the glass supplier The frame profiles are reinforced with glass filaments which are placed into the profiles in the longitudinal direction of the latter. Together with the glass panels, they produce a unit of the same e-modulus, so that shearing forces do not occur at the contact points between the glass panels and the frame. A connection which is secure and watertight over many years can therefore be produced. In an advantageous development of the invention, an optimum watertight bond can be achieved through the design of the topography of the inside of the frame profile together with a small amount of sealant. The step-shaped design of the two limbs of the frame profile that lie on the surfaces of the panel makes it possible to fasten a metal profile element in particular to the vertically running pane edges without a tool, the said metal profile elements forming the guide handle in the case of sliding doors and/or bearing a seal with respect to the adjacent window. The frame or the profiles forming the frame can be fixed in a simple manner angled entirely precisely with respect to one another onto the glass edges and can be fastened to the latter by being placed into a mould of v-shaped design during the curing of the adhesive/sealant.

Further advantageous embodiments emerge from the dependent patent claims.

BRIEF DESCRIPTION OF THE DRAWINGS

The subject matter of the invention is explained below with reference to preferred exemplary embodiments which are illustrated in the attached drawings, in which:

FIG. 11 shows a cross section through the frame profile in FIG. 10;

WAYS OF IMPLEMENTING THE INVENTION

Figure 1:
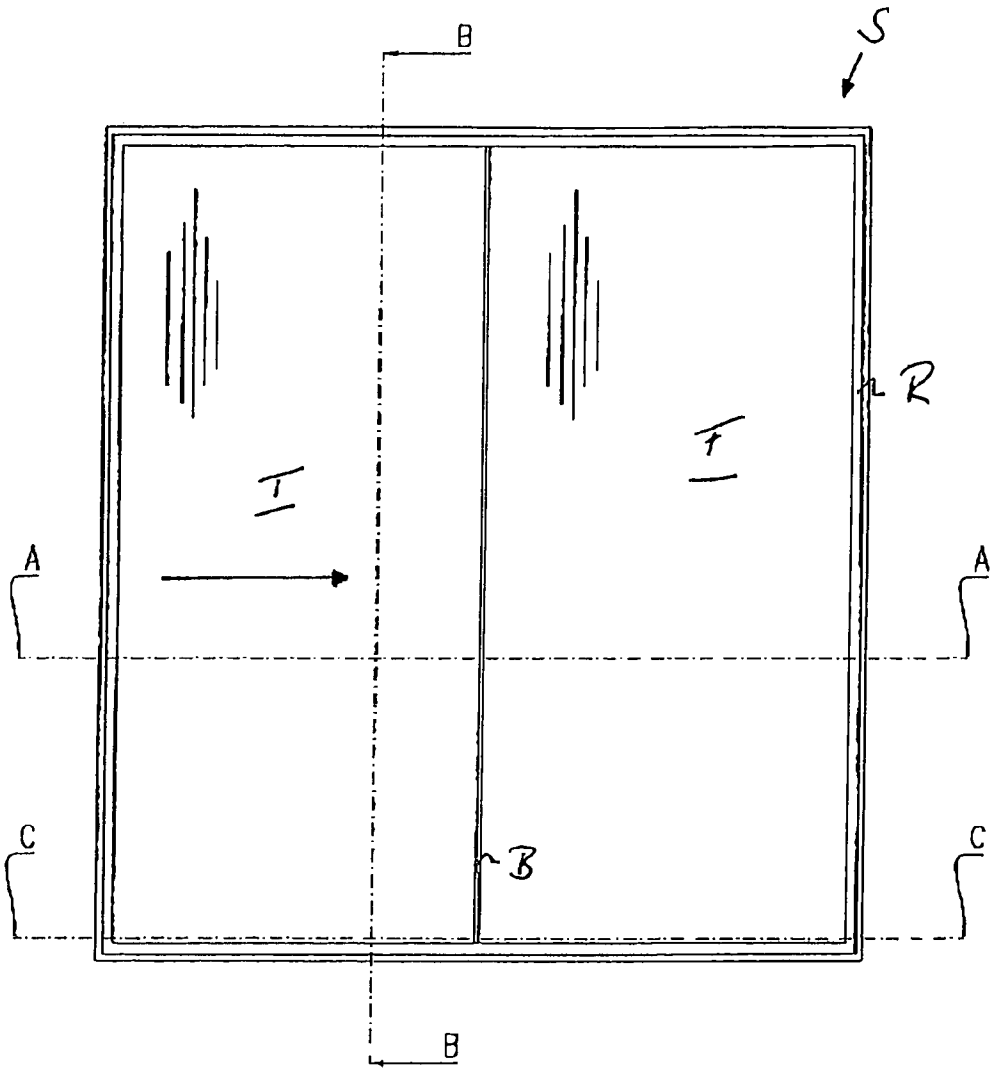
FIG. 1 shows a view of a sliding door with the frame construction according to the invention, according to a first embodiment.

FIG. 1 shows a sliding door S with a frame construction R, in which a fixed door wing F and a displaceable door wing T are arranged, according to a first embodiment. It is also possible to arrange the two door wings displaceably and/or to insert more than two door wings into the sliding door.

Figure 2:
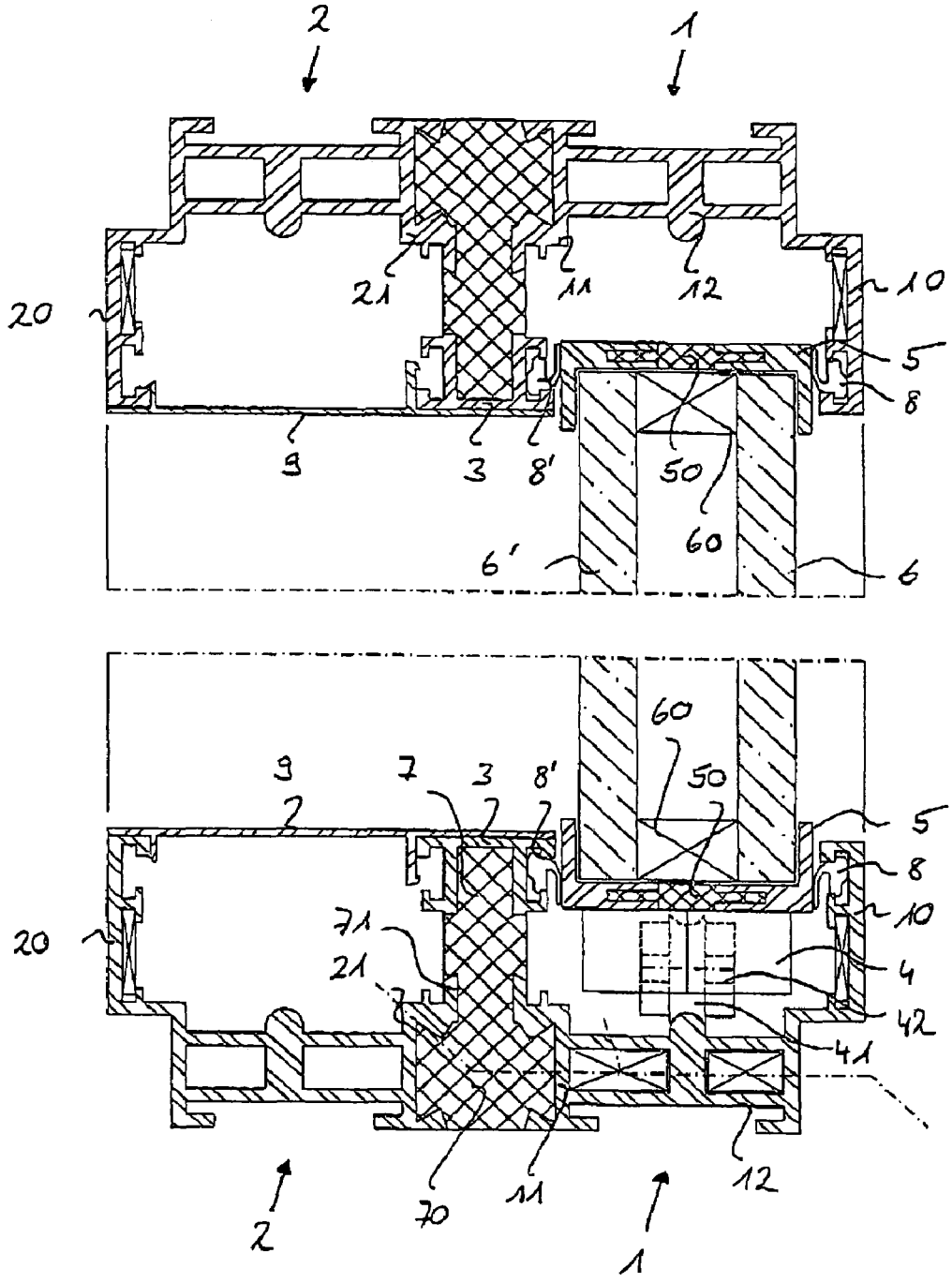
FIG. 2 shows a section along the line B-B according to FIG. 1.
Figure 3:
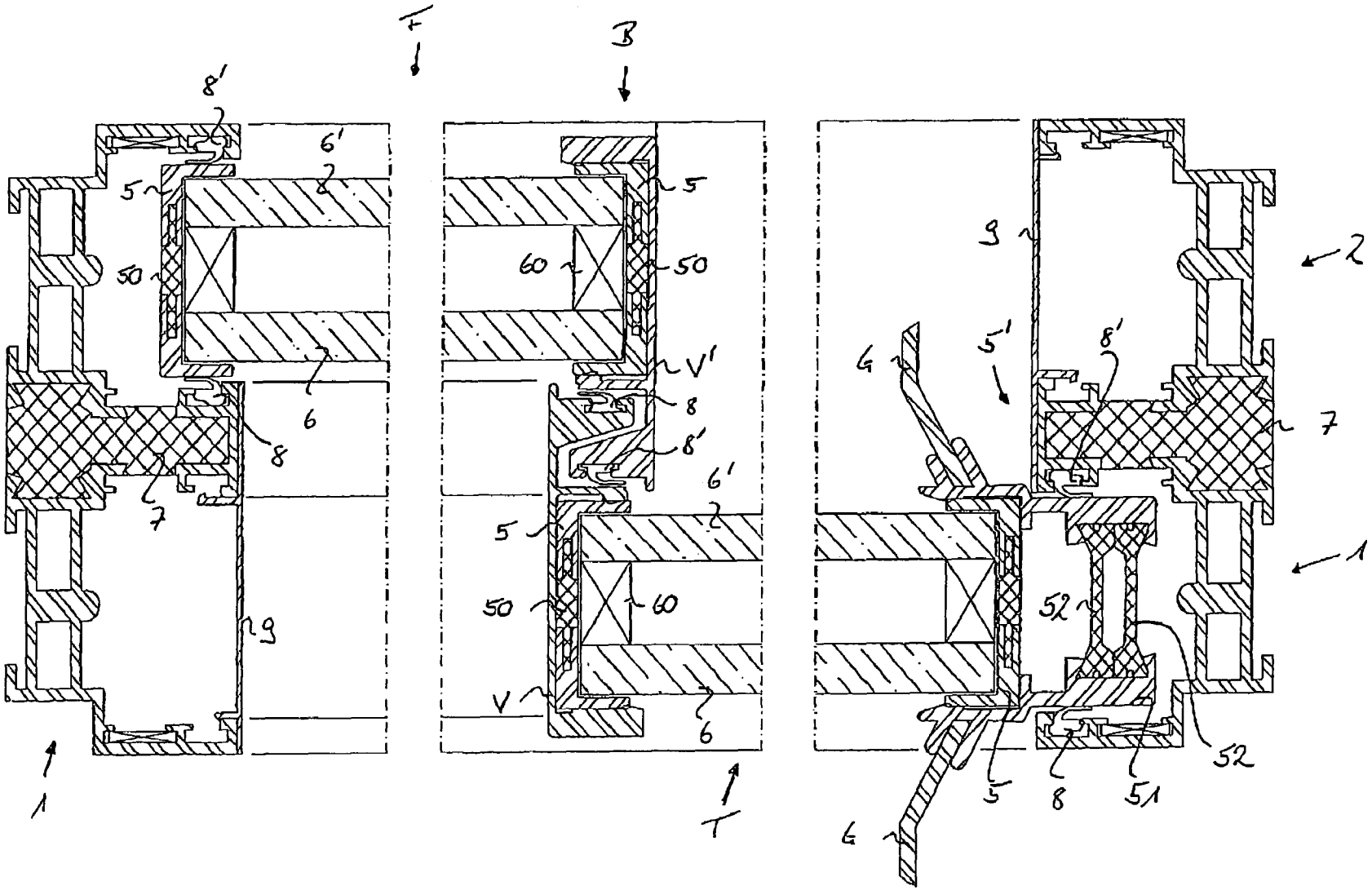
FIG. 3 shows a section along the line A-A according to FIG. 1.

The frame construction R according to the invention can be seen better in FIGS. 2 and 3. The main frame is divided into a first frame part 1 and a second frame part 2. The first frame part 1 is arranged here on the outside, the second frame part 2 on the inside.

However, the arrangement may also be reversed. The outer and the inner frame parts 1, 2 are each formed by four profile elements which each form one longitudinal side of the frame construction. The individual profile elements of a frame part 1, 2 are of identical design apart from their length. The lower and upper profile elements can be seen in FIG. 2 and the right and left profile elements in FIG. 3. In the following, reference is made to frame parts 1, 2, a corresponding profile element being meant in each case.

In the following, the frame construction is described with reference to FIG. 2. The first frame part 1 or the corresponding profile element has an essentially is unshaped cross section. In this case, an outer limb 10 of the frame part 1 is of longer design than an inner limb 11. The two limbs are connected to each other via a web 12.

The inner frame part 2 or the corresponding profile element is preferably of identical construction to the outer frame part 1. As a result, the production costs can be minimized. It is arranged mirror-symmetrically with respect to the first frame part 1, with the result that its inner limb 20 is directed inwards and its short limb 21 is directed outwards.

An insulating body 7 for preventing cold bridges is arranged between the two frame parts 1, 2. It is situated next to a plane defined by the window surface or door surface. This insulating body 7 extends over the entire length of the frame construction on all four sides. It is a profile element which is preferably manufactured from a heat-insulating plastic, from foam or from another suitable insulating material. It is also preferably of mirror-symmetrical design.

At its end remote from the door surface, it has a head 70 which tapers towards the centre of the insulating body to form a neck 71. This end is situated at the top, bottom, right or left depending on the side of the frame construction. The short limbs 11, 21 of the inner and outer frame parts 1, 2 have a shape matched thereto, so that they are retained in a form-fitting mainer on the insulating body 7. The form-fitting connection increases the stability. In this case, these short limbs 11, 21 extend preferably at maximum to halfway up the insulating body 7

A central frame part 3 of the main frame is clipped to that end of the insulating body 7 which faces the door surface. This central frame part is also preferably of symmetrical design. It likewise has an essentially u-shaped cross section, its web being extended on both sides and protruding outwards and the limbs being designed to be identical in length, with them being bent outwards in an L-shaped manner. In this case, the limbs are of such short design that the central frame part 3 is separated completely from the inner and outer frame parts 1, 2.

The individual frame parts 1, 2, 3 are preferably manufactured from metal, in particular aluminium. However, they may also be manufactured partially or entirely from plastic.

The door leaf of the fixed and also of the displaceable door wing F, T is arranged in a holding profile 5. This holding profile 5 is composed, in turn, of four individual profiles which extend along the sides of the frame construction and are connected to one another in a known manner. They are usually simply bonded to the glass panel of the particular door wing. The upper and lower holding profiles 5 of each door wing F, T are illustrated in FIG. 2 and the left and right holding profiles of each door wing F, T are illustrated in FIG. 3. The discussion below refers in turn firstly to FIG. 2.

The holding profile 5 has a unshaped, preferably symmetrical cross section. In the example illustrated here, each door wing F, T has double glazing, with the result that an outer glass panel 6 and an inner glass panel 6' are fixed in each holding profile 5, the said glass panels being retained at a distance from each other by means of a glass-edge bond 60.

The holding profile 5 has a web through which a heat-insulating insert element 50 preferably passes. Here too, in turn, a cold bridge from the outside to the inside is interrupted using insulation.

The frame part of the fixed door wing F, here the inner frame part 2, is covered in its region protruding towards the door wing by a covering profile 9, in particular of aluminium. This prevents dirt from passing into the upwardly open profile of the frame part 2. If both door wings are to be designed in a manner such that they can be displaced, the covering profile 9 is rendered superfluous.

The lower holding profile 5 of the displaceable door wing T is arranged on a running carriage 4. This running carriage 4 has at least one running wheel 41 which is mounted guided on an elevation of the lower web 12 of the outer frame part 1. Furthermore, it is guided by ball bearing guides 42 arranged at the sides of the running wheel 41, as shown in FIG. 2.

Sealing elements 8, 8' bear in a sliding manner between the displaceable holding profile S and the positionally fixed frame construction. These sealing elements 8, 8' extend preferably over the entire length of the holding profile 5 and therefore of the door surface. In the example illustrated here, the sealing elements 8, 8' are sealing lips which bear in a sliding manner against the holding profile 5 and are retained in corresponding holders of the frame construction by means of a thickened head. However, it is also possible to use brushes or differently shaped sealing elements.

The sealing lips have the advantage that they trap less dirt than the brushes. In one preferred embodiment, they are manufactured from a suitable plastic or rubber and have an integrated wire. This wire reinforces the sealing lips and prevents them from being dragged along by the displaceable door wing. The seal is therefore still guaranteed even after the sliding doors have been used for a relatively long time. These sealing elements with integrated wire can also be used in other frame constructions of sliding doors or sliding windows.

As illustrated in FIG. 2, the thickened head of the outer sealing element 8 is retained in a holding groove formed by the outer limb 10 of the outer frame part 1. By contrast, the inner sealing element 8' is retained by means of its thickened head in a holding groove of the central frame part 3, which groove is formed by the limb bent in an L-shaped manner and the protruding web. In the case of the inner frame part 2, it is exactly reversed. If brushes are used, they are preferably likewise retained in the frame construction.

Sealing elements 8, 8' of this type likewise bear in a sliding manner against the upper holding profile 5 of the displaceable door wing T. The said sealing elements are also, in turn, retained in the above-described parts of the frame construction.

As is apparent in FIG. 3, the holding profile 5 of the displaceable door wing T is retained on one side in a handle unit 5' on which an actuating handle G is arranged on one side, here on both sides. The handle unit 5' comprises two profile elements 51 and at least one insulating web, here two insulating webs 52 connecting the latter. In this case, the sealing elements 8, 8' do not bear in a sealing manner against the holding profiles 5, but rather against the handle unit 5'.

In another embodiment (not illustrated here), there is no central frame part 3. The insulating body 7 is shaped in the upper region in such a manner that it forms a respective holding groove for the inner sealing element and the outer sealing element.

In FIG. 3, the fixed window sash F and the transition region B from the fixed to the displaceable window sash F, T can be seen. The fixed window sash F is likewise retained on all four sides in a holding profile which is sealed with respect to the frame construction by sealing elements, preferably by the above-described sealing lips 8, 8'.

The transition region B comprises two connecting components V, V', which are of symmetrical design and are identically shaped, in the form of profile elements. Each connecting component v forms a fixed holder on the holding profile 5 of the fixed or of the displaceable door wing F, T. In addition, it has a V-shaped groove which is directed towards the other door wing and the outer limb of which forms a holding groove, which is directed outwards towards the other door wing, for the sealing element 8, 8'. The outer limbs of the particular V-shaped groove protrude into the V-shaped groove of the other connecting component V, V'. The conical design permits a satisfactory press-on pressure. The sealing elements 8, 8', bear against the inner limbs of the V-shaped grooves. As a result, optimum heat insulation is ensured by the sealing lip and the labyrinth-like transition region.

Figure 4:
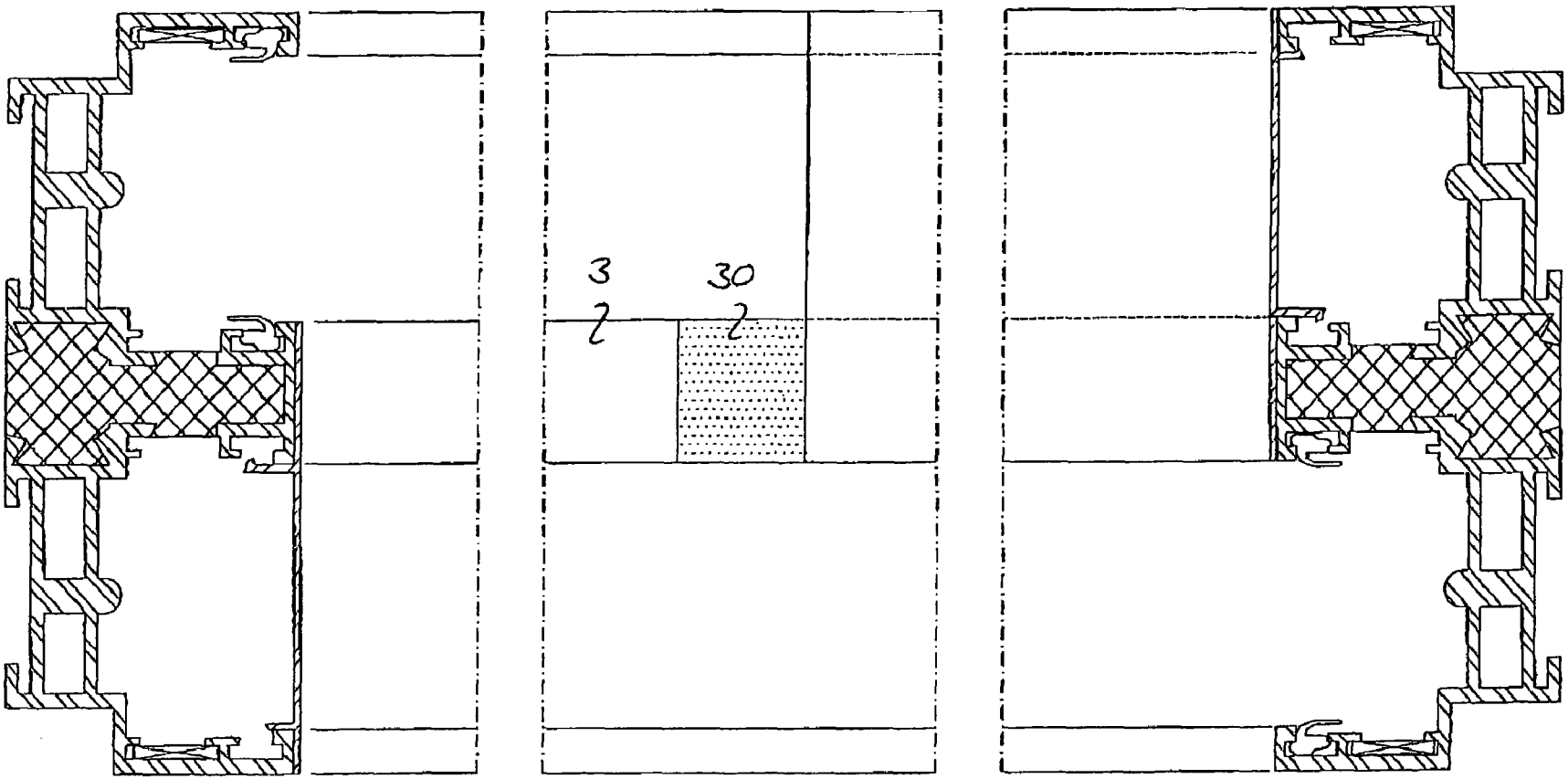
FIG. 4 shows a section along the line C-C according to FIG. 1.
Figure 5:
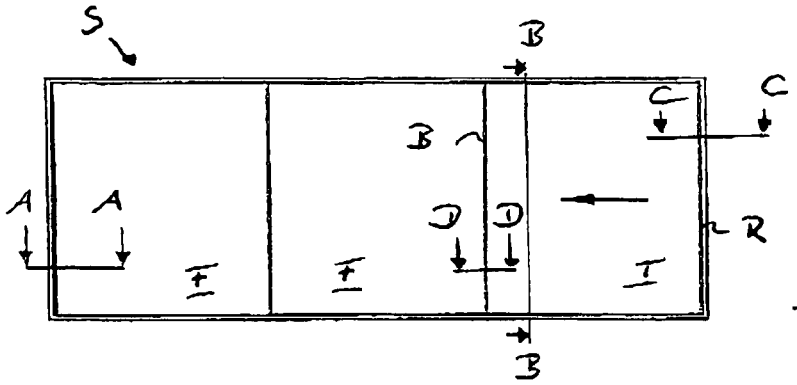
FIG. 5 shows a view of a sliding door with the frame construction according to the invention, according to a second embodiment.

It can be seen in FIG. 4 that the central frame part 3 is not of continuous design, but rather is interrupted by a further sealing part 30. This sealing part 30 is preferably a sealing brush, the bristles of which are directed towards the surface of the door wing. The interruption is situated between the fixed and the displaceable door wings T, F if the latter are in their closed position. This ensures that no parts protrude from the cold region into the warm region and therefore no cold bridges arise. If only the insulating body 7 is used without the central frame part 3, an interruption of this type is not necessary.

FIGS. 5 to 9 illustrate a second embodiment. Identical parts are provided with the same reference numbers and are therefore not described again in detail here.

The outer and inner sealing elements 8, 8' are preferably formed here by brushes. However, they may also be the above-described sealing lips. The inner sealing element 8' is not now retained in the central frame part 3, but rather between the insulating body 7 and central frame part 3. These two elements are of corresponding design in order to form a suitable holder, here a groove.

Figure 6:
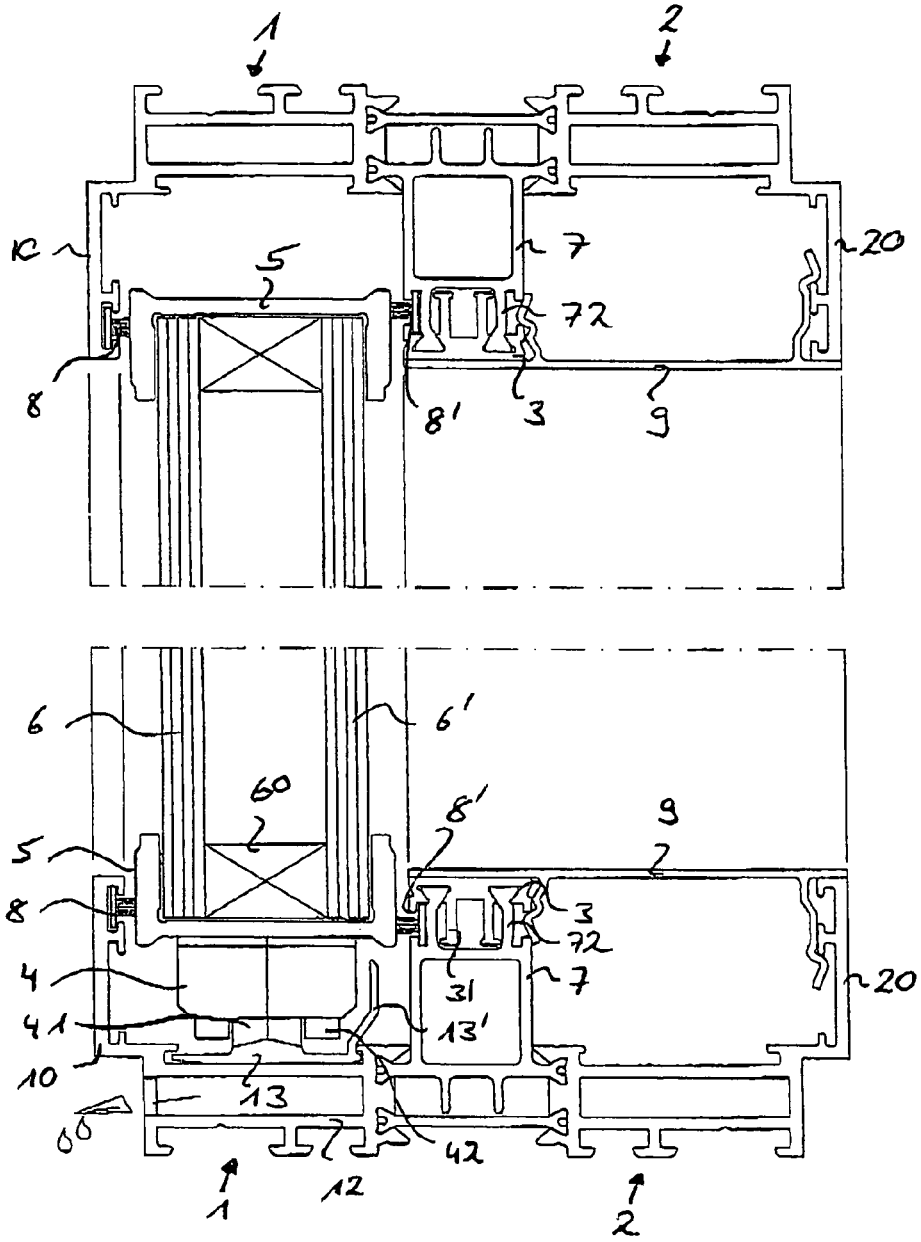
FIG. 6 shows a section along the line B-B according to FIG. 5.

As can be seen in FIG. 6, the insulating body 7 and the central frame part 3 have a different cross-sectional shape than in the first exemplary embodiment. In particular, the insulating body 7 is of hollow design in this example. In addition, the insulating body has arms 72 and the central frame part 3 has feet 31, which ensure a form-fitting connection of these two parts. The inner sealing element 8' can also be fastened in a simple manner to the outer side surfaces of the arms 74.

In a further variant (not illustrated here), the inner sealing element 8' is retained on the insulating body 7 which has a corresponding holding groove or other fastening means. However, the insulating body 7 may be covered as before by a central frame part 3, in particular of metal.

The running carriage 4 can likewise be seen in FIG. 6. In contrast to the embodiment according to FIG. 2, it is not now mounted on an elevation of the web 12 having a round cross section, but rather on an elevation having a triangular cross section. In addition, this elevation is preferably formed by a profile part 13 which is arranged in the web 12 and which has a lateral wall 13' as a means of protecting from sight and as a delimitation with respect to the insulating body 7.

Figure 7:
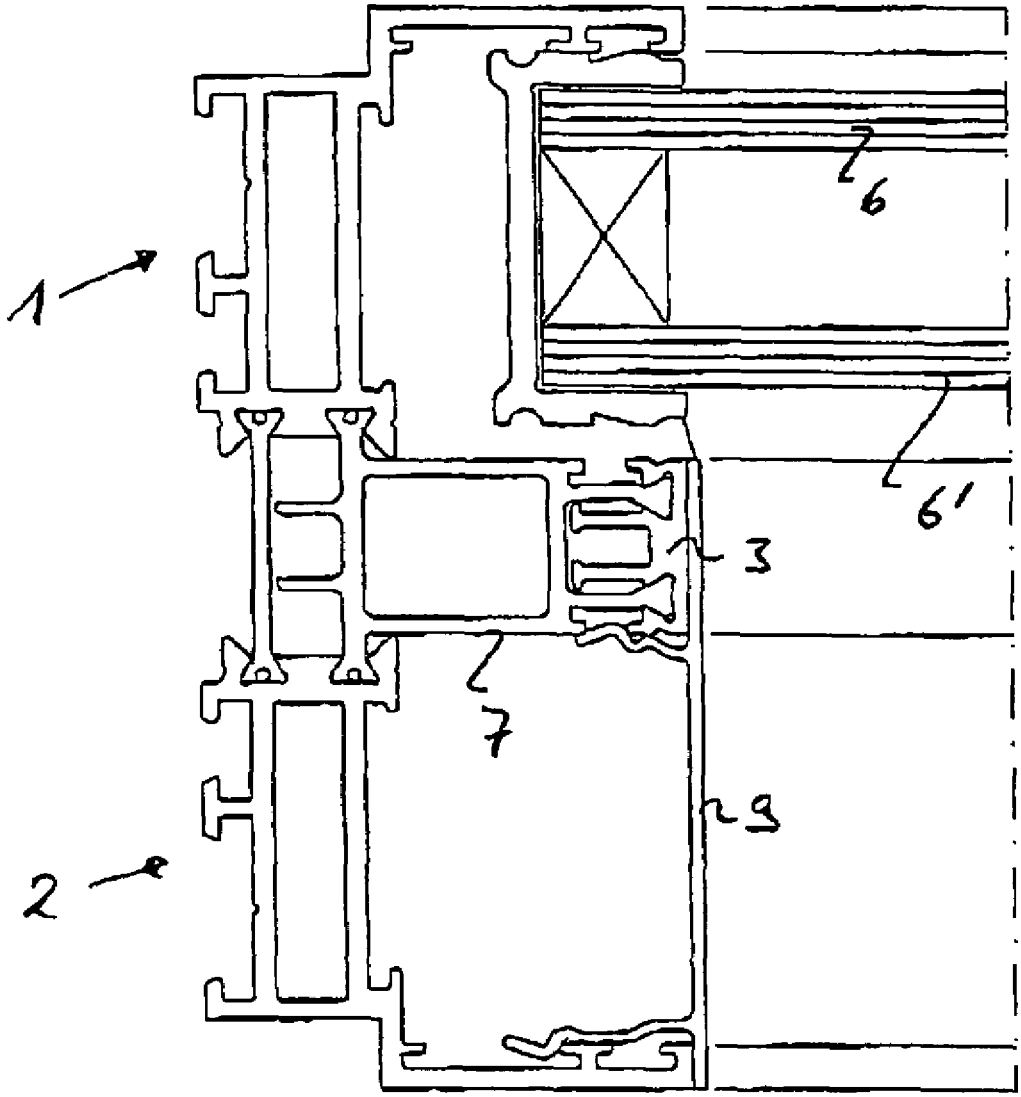
FIG. 7 shows a section along the line A-A according to FIG. 5.
Figure 8:
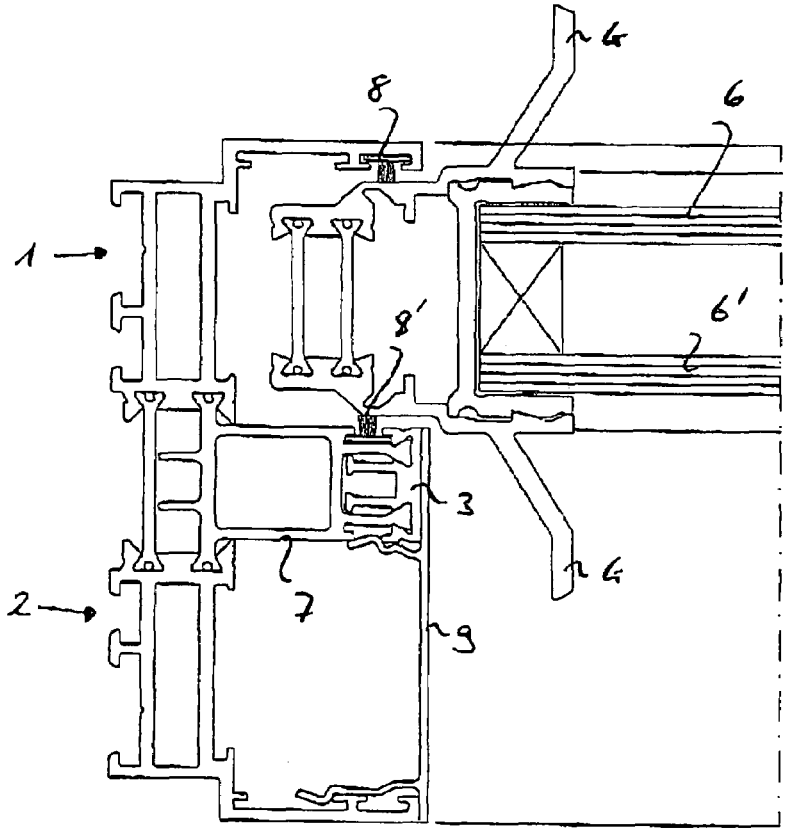
FIG. 8 shows a section along the line C-C according to FIG. 5.

FIG. 7 illustrates a section through the fixed window sash F, the inner and outer sealing elements 8, 8' not being drawn in. The construction corresponds to the section according to A-A and is therefore not repeated. FIG. 8 shows the section through the displaceable window or door wing T. Here too, the construction is again identical.

Figure 9:
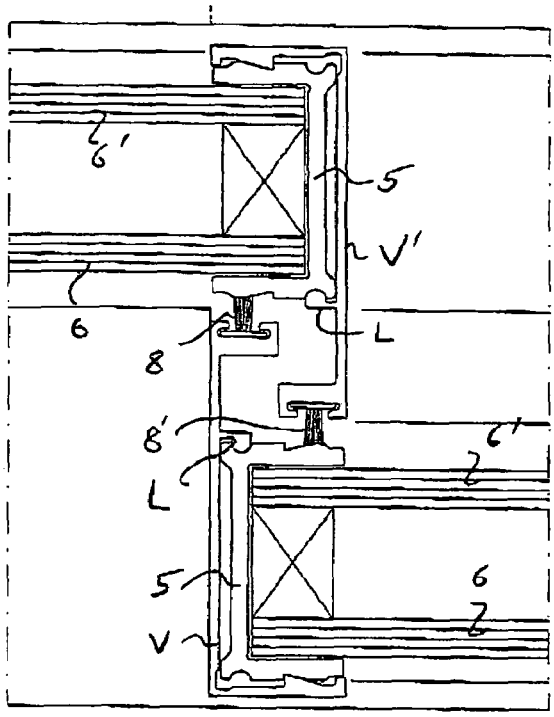
FIG. 9 shows a section along the line D-D according to FIG. 5.

FIG. 9 shows the transition region B between the fixed and displaceable window sashes. Again, there are connecting components V, V' which have holding grooves for the inner and outer sealing elements 8, 8'. In contrast to the first embodiment, the inner and outer sealing elements 8, 8' do not, however, bear against the other connecting components V, V', but rather make contact with the holding profiles 5. The limb L of the connecting component V, V' is correspondingly of shorter design than in the first embodiment. As a result, the insulation is further increased, since cold bridges can no longer arise here either.

Figures 10, 12, 13, 14:
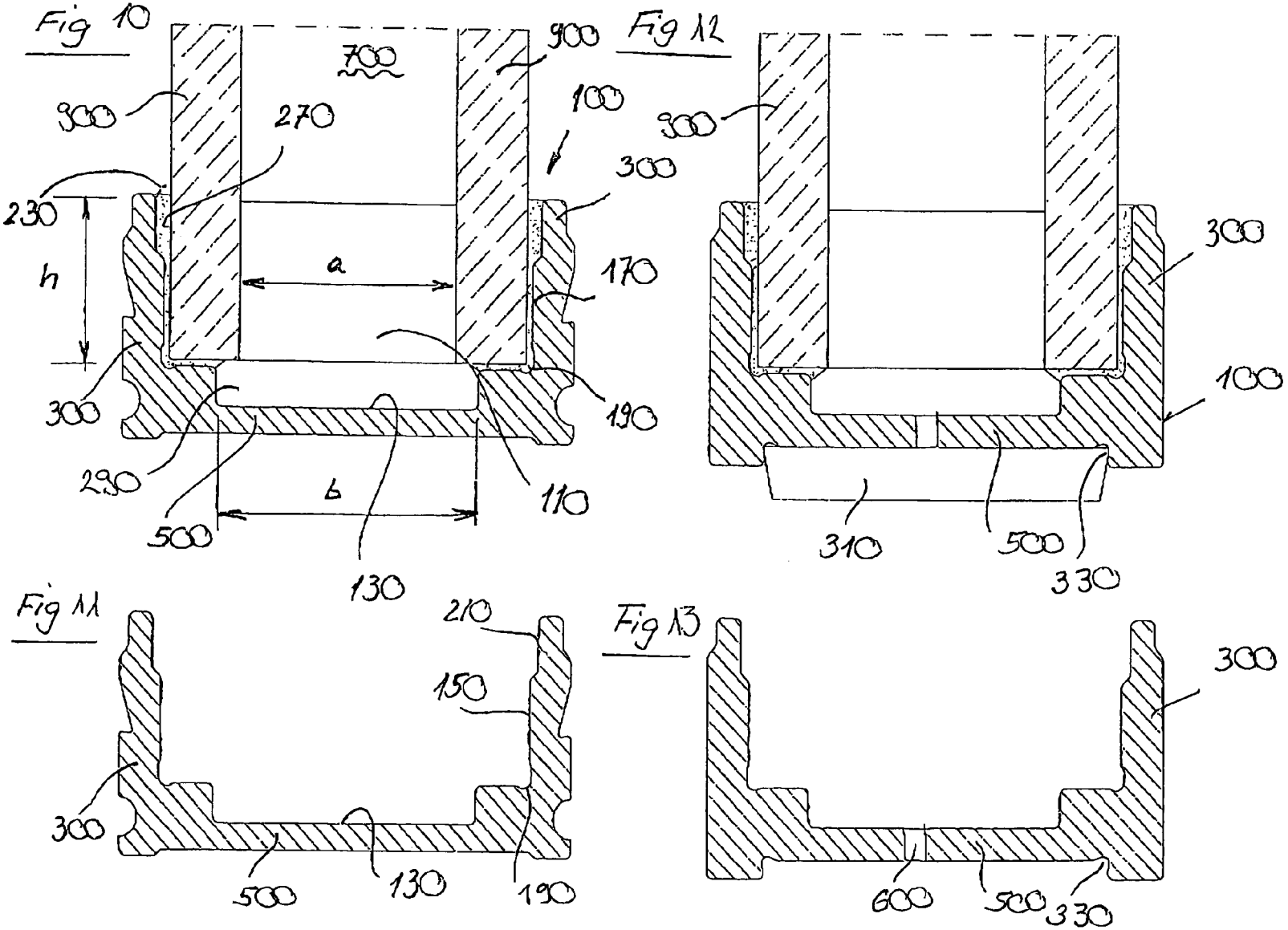
FIG. 10 shows a cross section through the edge of a glass panel, which is composed of panes of glass connected by a distance element, with frame profiles arranged vertically.
FIG. 12 shows a cross section through the edge of a glass panel, which is composed of panes of glass connected by a distance element, for profiles lying horizontally.
FIG. 13 shows a cross section through the frame profile in FIG. 12.
FIG. 14 shows a cross section through the edge of a glass panel, which is composed of panes of glass connected by a distance element, in a further embodiment of the invention.

The frame profiles which are illustrated in FIGS. 10 and 11, short profiles 100, have essentially a unshaped cross section, the height h of the two limbs 300 preferably being smaller in relation to the length 1 or to the width b of the base. One of the vertical edges of a glass panel 700 of a sliding door or a sliding window can be seen in FIG. 10 between the two limbs 300. The, said glass panel comprises two panes of glass 900 which are retained at a mutual distance by a distance-retaining element 110, generally a hollow profile. The distance-retaining element 110 is bonded in a leakproof manner on the inside to the two panes of glass 900.

The profiles 100 are manufactured from plastic reinforced with glass fibres, and the filament-shaped glass fibres are embedded in the profiles, 100 in the longitudinal direction thereof. Glass fibres are preferably combined into a bundle and inserted into the profile 100 with or without a casing consisting of glass fibres.

A recess 130 which runs along the profile 100 is let into the base 500 of the profile 100 on the glass-panel side. The said recess extends over a width b which corresponds approximately to the width a of the distance-retaining element 110 (cf. FIG. 10). The inner surfaces 150 of the two limbs 300 are preferably not designed over the entire height h of the planar surface, but rather only in a subregion 170. Plunge-cuts 190 and 210 which extend over the entire length of the profile 100 are formed above and below this subregion 170. In these two regions 190, 210, the distance between the surfaces of the panes of glass 900 and the inner surface 150 of the limbs 300 is enlarged. This makes it possible at these points to insert a relatively large amount of sealing and bonding compound 270 which can absorb relative movements between the profile 100 and the panes of glass 900, which movements are caused by weathering and cannot be one hundred per cent eliminated, i.e. possible small shearing forces are harmlessly absorbed by the bonding and sealing compound. Furthermore, this arrangement facilitates the introduction of a suitable quantity of sealing compound 270 both in the region lying horizontally and in the region lying vertically In particular, after the glass panel 700 is joined to the profile 100, sealing and bonding compound 270 can be inserted into the space arising between the panes of glass 900 and the limbs 300 in the region of the plunge-cuts 210 (cf. dot-dash line 230 in FIG. 10).

The space 290 arising between the plane formed by the lower edges 250 of the panes of glass 900 and the lower edge of the recess 130 permits rear ventilation and—if necessary—removal of water from the distance-retaining element 11 between the panes of glass 700 if moisture has penetrated this region Furthermore, the thin point formed by the recess 130 in the base 500 of the profile 100 brings about an optimum thermal separation of the two limbs 300 and, in particular, between the distance-retaining element 100, which consists of metal, and the inside and outside of the space. Holes 600 through which any moisture which has penetrated can emerge can be made in the base 500.

Figures 14, 15:
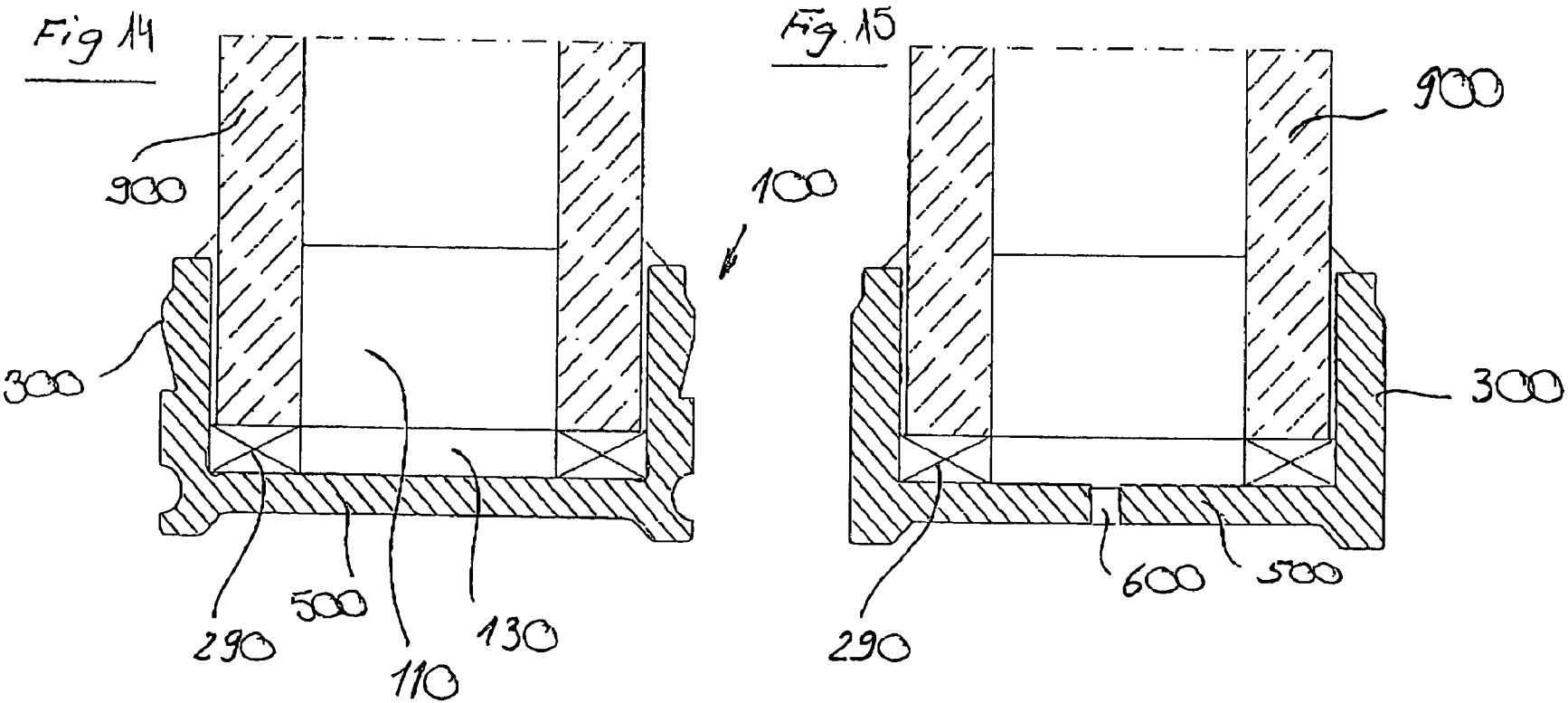
FIG. 15 shows a cross section through the frame profile in FIG. 14 in a further embodiment of the invention.

The outside of the limbs 300 of the profile 100 may be planar (compare FIGS. 13 and 14) or, as in FIGS. 10, 11 and 15, may have a profiling. The profiling according to the last-mentioned figures serves for the clipping of metal or plastic closure strips without using a tool on the profiles 100, which come to lie vertically against the sliding windows or sliding doors. The closure strip (no picture) serves, on the one hand, to carry handles with which the sliding doors or sliding windows can be grasped and displaced, and, on the other hand, sealing elements for the mutual sealing off of two glass panels 700, which can be displaced one above the other, can be fitted on these strips. The construction of these strips for sealing or as handle carriers is not explained in greater detail here.

The outwardly smooth limbs 300 of the variant according to FIGS. 13, 14 and 16 are inserted on those limbs of the glass panel 700 which are intended to lie horizontally, at a point at which no further elements have to be fastened. The profiles 100 serve there directly or indirectly to support running carriages or other roller carriers. In order to ensure optimum lateral guidance of the glass panels 700 even if the latter are not absolutely flat, a dovetail groove 330 may be formed on the base 500. Guide elements 310 which laterally guide the glass panel 700 and therefore the sliding door in a running rail (not illustrated) supporting the latter can be inserted into the dovetail groove 330. This also prevents the lateral sealing elements (not illustrated) from being nonuniformly compressed by means of a glass panel 700 which is not flat. The guide element 310 illustrated purely schematically in FIG. 13 is representative of guide elements 310 shaped in accordance with the running rails used.

In the refinement of the invention according to FIGS. 15 and 16, strips 290 which are rectangular in cross section are used in place of a recess in the base 500. The said strips bring the lower edges of the two panes of glass 900 and the distance-retaining element 110 situated in between to a distance from the surface of the base 500 and consequently form the recess 130. In this embodiment, additional work is needed for connecting the profiles 100 to the glass panel 700.

In the following, the mounting of the profiles 100 on the edges of the glass panels 700 is explained in greater detail. After the profiles 100 are cut to the dimensions corresponding to the glass panels 700 which are to be framed, rubber strips approximately 5 mm wide are inserted at more or less regular distances into the profiles 100 and then a sealing compound 270 is injected in the form of a bead. Placing the glass panel 700 onto it causes the sealing compound to be distributed in the intermediate space between the surface of the panes of glass 900 and the inside of the limbs 300 and the base 500. When sufficient sealing compound 270 has been injected, the excess quantity wells up in the region of the plunge-cut 210 and can be neatly severed there. If there is not sufficient sealing compound 270, this may also readily be retrospectively inserted into the plunge-cut 210. In order to obtain an absolutely rectangular alignment of the profiles 100 butting against the corners of the glass panels 700, the glass panel 700 is placed together with two adjacent profiles 100 in each case into a mould which comprises two surfaces which are situated at right angles with respect to each other and against which the profiles bear. After the sealing compound 270 has cured, for example overnight, the glass panels 700 can be provided with profiles on the two edges which still remain exposed and, correspondingly rotated through 180°, can be inserted into the mounting mould. The two supporting regions of the mould preferably lie at an angle of 45° with respect to the horizontal. The rubber strips (no picture) inserted into the profiles 100 before the sealing compound 270 is introduced serve for there to be a minimum quantity of sealing compound 270 at every point between the surface of the profiles 100 and the edges of the panes of glass 900, and consequently completely satisfactory sealing and bonding can take place.

Of course, the embodiments according to FIGS. 1-9 may also be provided with a retaining profile of this type. The retaining profile corresponds to the holding profile 5. In particular, the holding profile 5 according to FIGS. 5-9 can likewise be manufactured from a thermally insulating material, such as, for example, from plastic reinforced with glass fibres. The arrangement of the glass fibres may be selected as for the last example.

The frame construction according to the invention has improved heat insulation and can nevertheless be of relatively narrow design. In addition, the use of individual parts which are as symmetrical as possible makes it possible to minimize the production costs.

The invention claimed is:

1. Frame construction of a sliding door or a sliding window, including a main frame, a carriage (4) for the accommodation of a displaceable door leaf (T) or window sash, wherein the carriage (4) is disposed so as to be displaceable in a guided manner in the main frame, accommodating profiles (5) for accommodating the displaceable door leaf (T) or window sash, first sealing elements (8) engaged between the accommodating profiles (5) and an inner region of the main frame, and second sealing element (8'), engaged between the accommodating profiles (5) and an inner region of the main frame, and an insulating body (7), wherein the mainframe includes an outer and an inner frame part (1, 2), wherein the outer and inner frame parts (1, 2) are completely separated from one another by means of the insulating body (7) at least along a guideway of the carriage (4), wherein the second sealing element (8') abuts against a central frame part (3) of the main frame that is separated from the inner and outer frame parts (1, 2), wherein the central frame part (3) is fixed to the insulating body (7) in a positive locking manner, and wherein the central frame part (3) has a pair of frame sections made of metal which respectively extend horizontally from bottom ends of opposite vertical sides of the central frame part and have free ends which are spaced apart within the main frame.

2. The frame construction according to claim 1, wherein the free ends are fixed to a sealing portion (30) therebetween.

3. The frame construction according to claim 1, wherein the sealing part (30) is a sealing brush, the bristles of which are directed towards the face of the door leaf.

4. The frame construction according to claim 1, wherein sides of the inner and outer frame-parts (1, 2) are completely separated from that of the main frame by the insulating body (7), and in that one each side of the outer frame there are provided inner sealing elements (8') which abut against a central frame part (3), wherein the sides of the main frame include identically configured frame parts and insulating bodies and, where applicable, central frame parts.

5. The frame construction according to claim 1, wherein the second sealing part (8') is retained in an accommodating means of the central frame part (3) of the frame construction, the said accommodating means being formed by a portion that is curved in an L-shaped manner and a protruding web.

6. The frame construction according to claim 1, wherein in that each of the accommodating profiles (5) include a web, which is penetrated by a thermally insulated element (50), which interrupts a thermal bridge from outside to inside in an insulating manner.

7. The frame construction according to claim 1, wherein the carriage (4) includes at least one wheel (41) with a lateral ball bearing guide (42) on both sides.

8. The frame construction according to claim 1, wherein first sealing element (8) are retained in an outer portion of a frame part (12) and abut in a sliding manner against the accommodating profiles (5) , and in that second sealing elements (8w) are retained in the insulating body (7) or in the central frame part (3) or between insulating body (7) and central frame part (3) and abut in a sliding manner against the accommodating profiles (5).

* * * * *